US007469992B2

(12) United States Patent
Suzuki et al.

(10) Patent No.: US 7,469,992 B2
(45) Date of Patent: Dec. 30, 2008

(54) INK CARTRIDGE

(75) Inventors: Toru Suzuki, Kanagawa-ken (JP); Kiyomitsu Kudo, Tokyo (JP); Satoshi Kudo, Kanagawa-ken (JP); Akira Tsujimoto, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 10/566,172

(22) PCT Filed: Apr. 14, 2005

(86) PCT No.: PCT/JP2005/007576

§ 371 (c)(1),
(2), (4) Date: Jan. 27, 2006

(87) PCT Pub. No.: WO2005/100029

PCT Pub. Date: Oct. 27, 2005

(65) Prior Publication Data

US 2006/0232647 A1 Oct. 19, 2006

(30) Foreign Application Priority Data

Apr. 14, 2004 (JP) ..... 2004-118984

(51) Int. Cl.
*B41J 2/14* (2006.01)

(52) U.S. Cl. ..... 347/49

(58) Field of Classification Search ..... 347/49, 347/85, 86, 87

See application file for complete search history.

(56) References Cited

U.S. PATENT DOCUMENTS 4,855,762 A 8/1989 Suzuki ..... 346/140 R
5,500,664 A * 3/1996 Suzuki et al. ..... 347/86
5,523,780 A 6/1996 Hirosawa et al. ..... 347/86
5,552,816 A * 9/1996 Oda et al. ..... 347/86
5,619,237 A * 4/1997 Inoue et al. ..... 347/86
5,671,000 A * 9/1997 Hirabayashi et al. ..... 347/86
6,350,025 B1 * 2/2002 Morita et al. ..... 347/86
6,416,166 B1 * 7/2002 Robinson et al. ..... 347/49
6,715,865 B2 * 4/2004 Yamaguchi et al. ..... 347/87
6,840,610 B2 1/2005 Taniguchi et al. ..... 347/86
6,908,182 B2 * 6/2005 Nakazawa et al. ..... 347/86
2003/0156171 A1 8/2003 Yamaguchi et al. ..... 347/86
2005/0231572 A1 10/2005 Suzuki et al. ..... 347/87
2005/0270344 A1 12/2005 Tsujimoto et al. ..... 347/86
2006/0284944 A1 12/2006 Kudo et al. ..... 347/85

FOREIGN PATENT DOCUMENTS

JP 6-8463 1/1994

* cited by examiner

*Primary Examiner*—Anh T. N. Vo
(74) *Attorney, Agent, or Firm*—Fitzpatrick, Cella, Harper & Scinto

(57) ABSTRACT

The present invention makes it possible to improve the alignment accuracy of the joint section of an ink cartridge with an ink supply route of an inkjet head. Based on this, the present invention provides an ink cartridge capable of preventing ink leakage with high reliability and constructed inexpensively in a reduced size and particularly suitable for a pit-in system. To attain this, distance (L1) is set to be shorter than distance (L2), where the distance (L1) is the one between a joint section (145) positioned in the proximity of a front surface (1A) of an ink cartridge (1) and an engage reference portion (135) serving as a reference position when the ink cartridge (1) is installed in the inkjet printing apparatus; and the distance (L2) is the one between the front surface (1A) of the ink cartridge (1) and the engage reference portion (135).

2 Claims, 10 Drawing Sheets

INK CARTRIDGE

TECHNICAL FIELD

The present invention relates to an exchangeable ink cartridge containing ink for use in an inkjet printing system.

BACKGROUND ART

As one of inkjet printing apparatuses, a pit-in system printing apparatus has been provided which comprises at least an inkjet head, a sub tank for supplying ink to the inkjet head, and a main tank for supplying ink to the sub tank. When printing is made on a printing medium such as paper and a card by such a pit-in system printing apparatus, the inkjet head ejects ink while it moves in a direction (main scanning direction) perpendicular to a feeding direction (sub-scanning direction) of the printing medium. Furthermore, the sub tank is periodically connected to the main tank to supply ink from the main tank to the sub tank.

The inkjet head and the sub tank are integrally formed into one body and mounted on a carriage moving in the main scanning direction. On the other hand, the main tank is housed in an inkjet printing apparatus in the form of an exchangeable ink cartridge, and a connecting member is provided with the main tank for connecting to the sub tank provided in the inkjet head.

When the sub tank is replenished with ink from the ink cartridge (main tank), the sub tank is moved together with the inkjet head as well as the cartridge to a predetermined position facing the ink cartridge (main tank), and then the sub tank is connected to the ink cartridge by the connecting member, thereby replenishing the sub tank with ink.

Such a pit-in system particularly requires a mechanism for replenishing the sub tank with a predetermined amount of ink in just proportion. Therefore, the ink cartridge and the sub tank must be connected by the connecting members without fail. Furthermore, since the sub tank is replenished with ink in plurality of times with consumption of the ink in the sub tank, it is important for the connecting member to have reliability over ink leakage and durability. To improve the reliability over connection, accuracy in alignment of the sub tank with ink cartridge must be improved.

For example, Japanese Patent Laid Open No. 6-8463 describes the structure of the connecting section between the inkjet head and the ink cartridge of an inkjet printing apparatus. According to the description, the inkjet head is equipped with a liquid supply needle serving as an ink receiving section; at the same time, the ink cartridge is equipped with a connecting member serving as a joint section for supplying ink. The ink cartridge described in Japanese Patent Laid Open No. 6-8463 is shown in FIGS. 8 to 10.

As shown in these figures, the ink cartridge has a rectangular ink cartridge container 51 and a plurality of ink bags 52. The inner space of the ink cartridge container 51 is partitioned longitudinally into a plurality of spaces. The plurality of spaces partitioned each house an ink bag 52. In the end surface of the ink cartridge container 51, a plurality of ink deriving sections 53 for deriving ink 54 are provided correspondingly to the ink bags 52.

In each of the ink deriving sections 53, a connectable member 56 to an ink supply pipe 55 from the printing apparatus and a receiving portion 58 receivable for an aligning pin 57 of the printing apparatus are provided. The ink supply pipe 55 is connected to an inkjet head (not shown).

The ink cartridge container 51 is provided along a guide rail 59 of the printing apparatus. To a pipe fixing table 61 of the printing apparatus, the ink supply pipes 55 and the aligning pins 57 are fixed. When the ink cartridge container 51 is installed, the ink supply pipes 55 each pass through the connecting member 56 and enter the ink bag 52. In the stage where the ink supply pipe 55 is connected to the connecting member 56, the aligning pin 57 is fitted in the receiving portion 58, thereby aligning the connecting member 56 so as to face the ink supply pipe 55. During the aligning time, the ink deriding section 53, which is a joint section with the ink supply pipe 55, must be slid in the direction indicated by the double headed arrow in FIG. 10. Therefore, the ink deriving section 53 is held with a gap 60 interposed between the section 53 and the periphery.

Thus, when the inkjet head and the ink cartridge are connected, they are aligned with each other by sliding the ink deriving section 53 (joint section). As is apparent from FIG. 8, a plurality of ink deriving sections 53 are arranged at substantially the same intervals and distributed uniformly from the center of the ink cartridge.

In the ink cartridge described in Japanese Patent Laid Open No. 6-8463, such a connecting section is constructed on the assumption that the user may generally perform connection and disconnection of the ink cartridge for exchange one to few times.

However, in the pit-in ink system where ink is supplied as mentioned above, the sub tank provided to the inkjet head is replenished with ink a plurality of times as ink is consumed by the inkjet head. The replenishment may be performed several tens to several hundreds of times as the ink cartridge increases in volume. Every time the sub tank is replenished with ink, the inkjet head equipped with the sub tank and the ink cartridge has to be connected repeatedly. If the connection is made one to several times, the connecting member 56 such as a rubber cap, is not so significantly damaged, so that leakage of ink from a flaw formed in the connecting member 56 or due to breakage of a slit may not conceivably occur.

However, when the ink cartridge and inkjet head are connected repeatedly several tens to several hundreds of times, a flaw may be generated in the connecting member 56 and the slit of the connecting member 56 may be broken. The flaw and breakage of the connecting member 56 may cause leakage of ink from the slit of the connecting member 56 even though the ink supply pipe 55 serving as a liquid supply needle is inserted or not.

A general inkjet printing apparatus widely in use ejects ink drops of various colors from a plurality of inkjet heads so as to overlap them on a printing medium to print a color image on the medium. In general, when a color image is printed, three color inks such as yellow (Y), magenta (M), and cyan (C), or four color inks including black ink (Bk) besides these three inks are used. To correspond to these three or four color inks, three or four types of inkjet heads and ink cartridges are used. Recently, an inkjet printing apparatus having three or four types of inkjet heads installed therein for printing a full color image has been put into practical use. Furthermore, an inkjet printing apparatus capable of printing an image with high color reproducibility by using six color inks including light magenta and light cyan inks, or red and blue inks in addition to the four color inks is also put into practical use.

The ink cartridge of such an inkjet printing apparatus has a plurality of ink containers within the device for storing a plurality of inks separately. In both of such ink cartridge and sub tank provided to the inkjet heads, a plurality of connecting sections corresponding to individual ink colors are simultaneously connected.

When the inkjet head equipped with sub tank and ink cartridge are connected, if the accuracy of aligning is poor, the durability of the connecting section decreases. In particular, when connection is repeated for numerous times, leakage of ink may take place and pollute the user's hand as well as the interior space of the printing apparatus.

DISCLOSURE OF THE INVENTION

An object of the present invention is to provide an ink cartridge particularly suitable for a pit-in system, having high reliability in preventing leakage of ink and constructed inexpensively in a reduced size by improving the alignment accuracy of the joint section of the ink cartridge to an ink supply route of the inkjet head.

There is provided an ink cartridge installed in an inkjet printing apparatus printable by use of an inkjet head, and connectable to an ink supply route of the inkjet head, comprising:

an engage reference portion serving as a reference position in installing the ink cartridge in the inkjet printing apparatus; and a joint section positioned in the proximity of a side surface of the ink cartridge and connectable to the ink supply route, wherein the distance between the joint section and the engage reference portion is shorter than that between the side surface and the engage reference portion.

The present invention defines the positional relationship between a side surface of the ink cartridge, a joint section positioned in the proximity of the side surface, and an engage reference portion, which is a reference position when the ink cartridge is installed in the inkjet printing apparatus. More specifically, the distance between the joint section and the engage reference position is set to be shorter than the distance between the side surface of the ink cartridge and the engage reference portion.

With this structure, when the ink cartridge installed in the inkjet printing apparatus wobbles around the engage reference portion, the deviation amount of the joint section generated by the wobbling can be suppressed to a minimum. As a result, the joint section of the ink cartridge can be accurately aligned with the ink supply route of the inkjet head and securely connected.

According to the present invention, it is possible to reduce the deviation amount of the joint section in the ink cartridge. Therefore, even if the connection between the ink supply route of the inkjet head and the joint section of the ink cartridge is frequently repeated, the joint section is not inadvertently damaged. As a result, it is possible to provide an ink cartridge having high reliability over leakage of ink. Furthermore, since no complicated structure is required, the ink cartridge can be constructed simply, with result that the ink cartridge can be manufactured inexpensively in a reduced size.

BEST MODE FOR CARRYING OUT THE INVENTION

The Embodiments of the present invention will be described by way of the drawings.

EMBODIMENT 1

Figure 1:
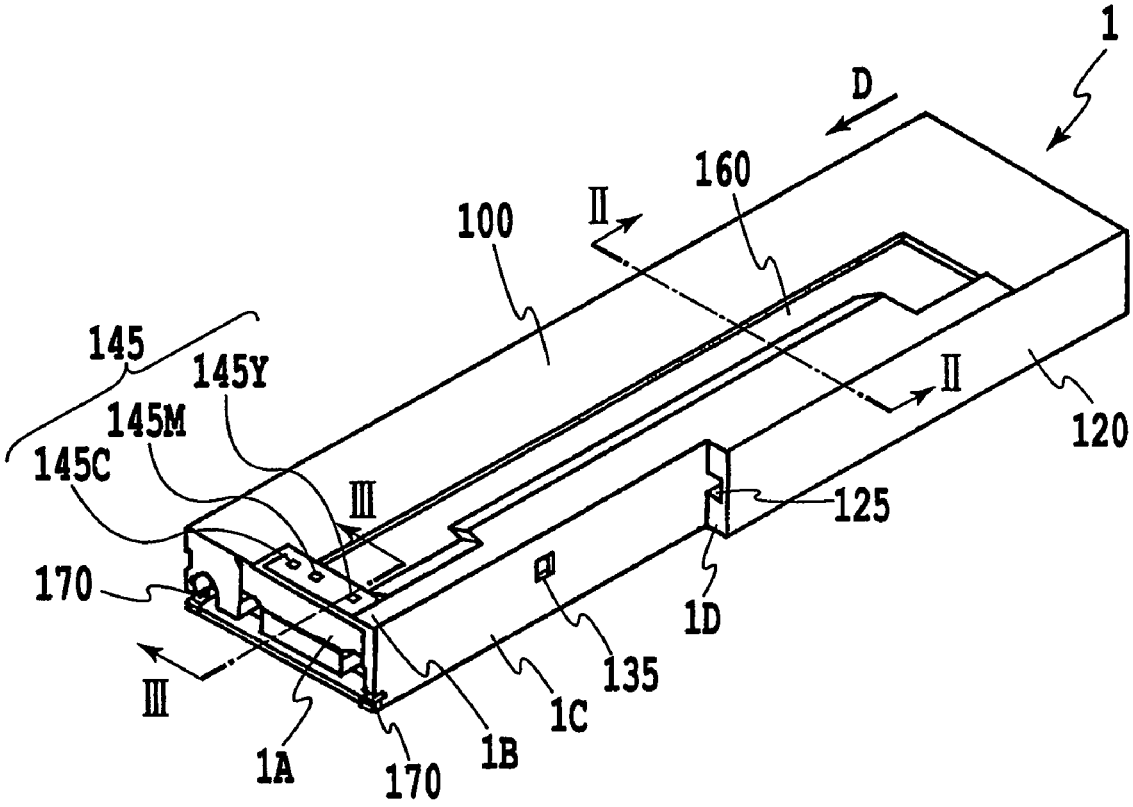
FIG. 1 is a schematic perspective view of the entire ink cartridge according to Embodiment 1 of the present invention.

FIG. 1 is an external perspective view showing an ink cartridge according to Embodiment 1 of the present invention.

The ink cartridge 1 of the present invention comprises a container as a primarily exterior structure, which is constituted of a case portion 120 and a cover portion 100 positioned on the upper surface of the case portion 120. In the case portion 120, ink containers for storing inks are housed, and the cover portion 100 houses an ink absorption member 220. When printing is made, without white border (hereinafter referred to as "margin-less printing"), on a printing medium such as general paper or a card by use of an inkjet head (described later), the ink absorption member 220 receives and absorbs ink that is ejected from the inkjet head but does not land on the printing medium. The cover portion 100 has an opening 160 from which the ink absorption member 220 is exposed.

The ink cartridge 1 of this Embodiment is applied to the pit-in system as described above. In the pit-in system, an inkjet head equipped with a sub tank is installed on a carriage of the inkjet printing apparatus, whereas the ink cartridge 1 is installed in a main body of the inkjet printing apparatus. When the inkjet head moves to a predetermined home position together with the carriage, the sub tank provided in the inkjet head is replenished with ink supplied from the ink cartridge 1. Therefore, a joint section (connecting section) 145 connectable to the sub tank attached to the inkjet head is provided at an end portion of the ink cartridge 1 for supplying ink.

In the Embodiment, yellow, magenta, and cyan inks are stored in the ink cartridge 1. In the joint section 145, there are joint sections 145Y, 145M and 145C corresponding to these inks. In FIG. 1, reference symbol 145Y indicates the joint section for supplying yellow ink, reference symbol 145M indicates the joint section for supplying magenta ink, and reference symbol 145C indicates the joint section for supplying cyan ink.

The ink cartridge 1 is introduced along the insertion direction indicated by arrow D in FIG. 1 and installed in a predetermined installation section of the main body of the inkjet printing apparatus. The ink cartridge 1 of the Embodiment has virtually rectangular. Reference symbol 1A indicates a front-surface (one side surface) positioned in the leading side of the insertion direction (indicated by arrow D), reference symbol 1B indicates the upper surface, and reference symbol 1C indicates a side surface. These surfaces 1A, 1B and 1C are adjacent to each other. In the upper surface 1B, the joint section 145 is positioned at the end portion near the side of the front-surface 1A (one side surface). A discharge ink opening portion 125 (described later) is positioned in the surface 1D, which is formed at the backward portion from the front surface 1A of the ink cartridge 1 in the insertion direction (indicated by arrow D). In the side surface 1C of the ink cartridge 1, a groove-form engage reference portion 135 is formed at the forward portion from the surface 1D in the insertion direction (indicated by arrow D). The engage reference portion 135 is used as a reference point when the ink cartridge 1 is installed in the inkjet printing apparatus.

The inkjet printing apparatus has a fixation pin (not shown) which engages with the engage reference portion 135 and fixes the ink cartridge 1 when the ink cartridge 1 is installed in a predetermined installation section within the inkjet printing apparatus. The engagement of the engage reference portion 135 with the fixation pin is released by a releasing lever (not shown). To be more specifically, when the releasing lever is operated, the fixation pin engaged with the engage reference portion 135 inclines toward the reverse direction (opposite-insertion direction) to the insertion direction (indicated by arrow D) of ink cartridge 1, around its support shaft. In this mechanism, the fixation pin pushes the ink cartridge 1 in an opposite direction to the insertion direction (indicated by arrow D) and is simultaneously disconnected from the engage reference portion 135.

Figure 2:
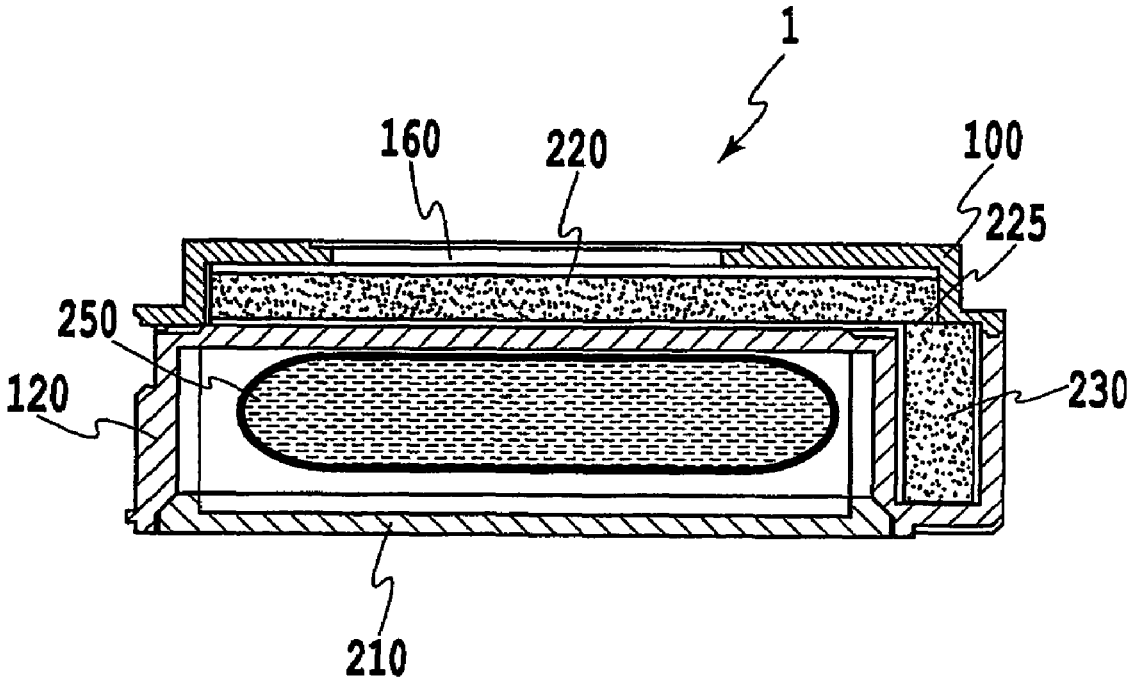
FIG. 2 is a sectional view taken along the II-II line of the ink cartridge shown in FIG. 1.

Next, the inner structure of the ink cartridge 1 shown in FIG. 1 will be explained. FIG. 2 is a sectional view taken along the line II-II of FIG. 1.

In FIG. 2, the ink cartridge 1 houses an ink container 250, which stores ink to be used in inkjet printing apparatus. Reference numeral 210 indicates the bottom plate of the case portion 120.

In a side portion of the case 120, a discharged-ink absorption member 230 is housed. The discharged-ink absorption member 230 absorbs ink discharged from the inkjet head by a recovery operation by suction. In the recovery operation by suction, ink which does not contribute to printing of images is suctioned and discharged from ejection ports into a cap (not shown) covering the ejection ports of the inkjet head. By this operation, it is possible to maintain ejection state of ink from the inkjet head in good conditions. The mechanism for carrying out the recovery operation by suction (not shown) serves to suction and withdraw ink from the inkjet head and then discharge through an ink discharge pipe (not shown). When the ink discharge pipe is inserted in a discharge ink opening portion 125 shown in FIG. 1, ink suctioned and withdrawn from the inkjet head is introduced through the discharge ink opening portion 125 to the ink cartridge 1 and then absorbed by the discharged-ink absorption member 230.

The discharged-ink absorption member 230 is connected to the ink absorption member 220 arranged on the upper surface of the case portion 120 by a joint section 225.

Figure 3:
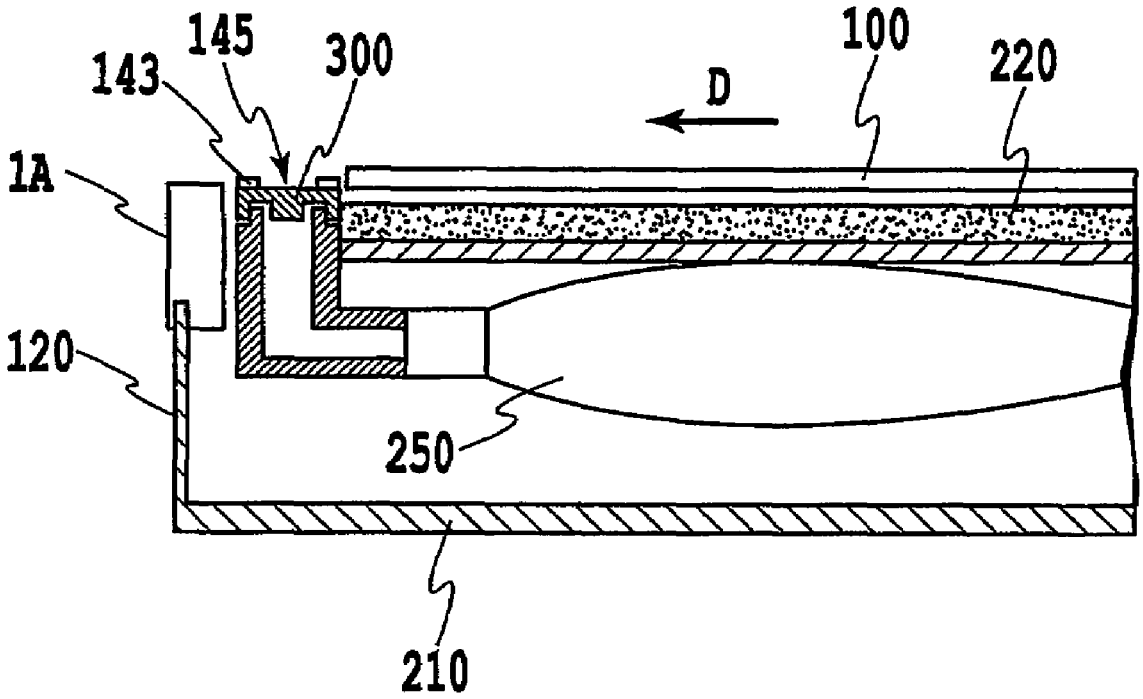
FIG. 3 is a sectional view taken along the III-III line of the ink cartridge shown in FIG. 1.

FIG. 3 is a sectional view of the ink cartridge 1 of FIG. 1, taken along the line perpendicular to the direction along which joint sections 145 are aligned and shows the peripheral portion of the joint section 145. In short, FIG. 3 is a sectional view taken along the line III-III of FIG. 1.

The joint sections 145C, 145M and 145Y for supplying ink are arranged in the same plane. In the joint section 145, a sealing member 300 is attached in order to prevent ink leakage and vaporization of ink until the ink cartridge 1 comes to use. In this embodiment, chlorinated butyl rubber low in gas and vapor permeability is used as the sealing member 300. Any material may be used as the sealing member 300 as long as it is resistant to ink to be used and suppresses vaporization of ink therefrom. Furthermore, the sealing member 300 is desirably formed of a material, through which a needle member 21 (shown FIG. 4) of the inkjet head can be inserted or removed by application of small force, as described later. Examples of such a material for the sealing member 300 may include silicon rubber and styrene rubber capable for use in elastomer-molding. The sealing member 300 is pressed by a press board 143 against the position of the joint section 145. The press board 143 has an opening portion formed for inserting the needle member 21 (described later).

In the Embodiment, a bag-form ink container deformable depending upon the content of ink is used as the ink container 250. The bag-form ink container 250 is formed of multiple-layered film, which is formed by laminating a polypropylene (PP) layer, an aluminum foil layer, and polyethylene terephthalate (PET) layer in a dry state in the order from the inside surface to the outside surface. Each layer has a thickness of several microns to several tens of microns. Any material may be used for the ink container 250 as long as it is resistant to ink to be used and it gives no elution product having an effect upon ejection of ink and supply of ink in the inkjet head, in other words, it rarely elutes a product such as metal salt of aliphatic acid. Furthermore, it is desirable that a material capable of suppressing change of ink color, which is caused by vaporization of ink during storage in the container 250, is used as a material for the ink container 250. Moreover, as a material for the ink container 250, a film formed by depositing $SiO_x$ and $Al_2O_3$ on a PET substrate may be used in place of aluminum foil layer used in the Embodiment.

When ink stored in the ink container 250 of the ink cartridge 1 is consumed and used up, a new ink cartridge 1 is inserted in the inkjet printing apparatus in exchange for the ink cartridge 1. In this mechanism, the printing operation can be maintained. To keep a sufficient amount of ink capable of making a print on 70 sheets of paper as a printing medium, 4.5 g of ink is stored in the ink container 250. In this Embodiment, each of the ink containers 250 containing cyan, magenta, and yellow inks stores 4.5 g of ink in the ink bag.

Figure 4:
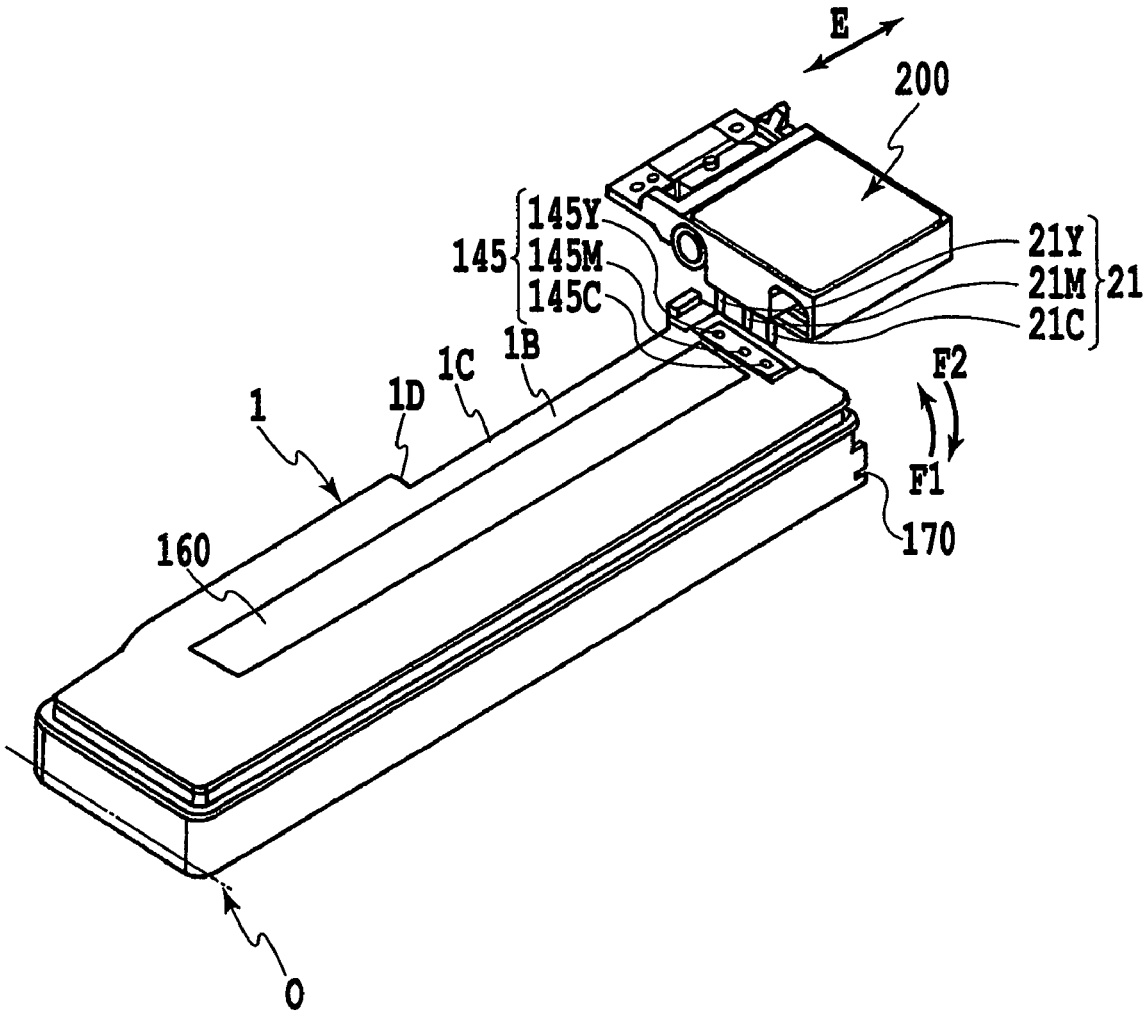
FIG. 4 is a perspective view for explaining the relationship between the ink cartridge and the inkjet head according to Embodiment 1 of the present invention.

FIG. 4 is an external perspective view showing the relationship between the inkjet head 200 and the ink cartridge 1 when the inkjet head 200 moves to the home position. The inkjet head 200 equipped with a sub tank is mounted on the carriage of the inkjet printing apparatus and moves in a main scanning direction. The inkjet printing apparatus is capable of ejecting ink stored in the sub tank from the ejection port of the inkjet head section.

As shown in FIG. 4, the inkjet head 200 has hollow needle members 21 (21Y, 21M, 21C), which are provided so as to correspond to joint sections 145 (145Y, 145M, 145C) of the ink cartridge 1, respectively. Furthermore, the inkjet head 200 has three sub tanks (not shown) communicating respectively with hollow portions of three needle members 21Y, 21M, and 21C, as well as three inkjet head sections (not shown), which can eject ink supplied from these three sub tanks. These three sub tanks are replenished with yellow, magenta, and cyan inks from the joint section 145Y, 146M and 145C of the ink cartridge 1, through the needle members 21Y, 21M and 21C. The ink stored in each of these sub tanks can be ejected from the ejection port of the corresponding inkjet head section.

An image is printed on the printing medium by alternately repeating an operation for ejecting ink from the inkjet head 200 while reciprocally moving the head in the main scanning direction (as indicated by arrow E in FIG. 4) and an operation for feeding the printing medium at a predetermined rate in a sub scanning direction perpendicular to the main scanning direction. Such printing operation is similar to that performed in the inkjet printing apparatus of a general serial scan system.

The inkjet head 200 moves together with the carriage to the home position shown in FIG. 4 when the printing is not made. In the home position, a sub tank of the inkjet head 200 can be replenished with ink from the ink cartridge 1 installed in the inkjet printing apparatus. That is, ink is replenished as follow. First, the ink cartridge 1 installed in the inkjet printing apparatus is rotated about a predetermined rotation center axis O (see FIGS. 4, 5A and 5B) along the direction indicated by arrow F1 (see FIGS. 4, and 5B) by a driving mechanism (not shown) provided in the inkjet printing apparatus. By this operation, the needle member 21 (21Y, 21M, 21C) is inserted into the corresponding joint section 145 (145Y, 145M, 145C), thereby constructing an ink supply route from the ink cartridge 1 to the sub tank of inkjet head 200.

The rotation center axis O is a virtually perpendicular to the side surface 1C of the ink cartridge 1 and virtually parallel to the front surface 1A. The rotation center axis O is set at a position far from the front surface 1A of the ink cartridge 1. Therefore, when the ink cartridge 1 rotates about the rotation axis O in the upper direction pointed by arrow F1, the front surface 1A moves so as to describe trail L of circular arc having a large rotation radius (see FIG. 5B). FIG. 5B shows the trail L described by the outermost peripheral portion of the ink cartridge 1, which is the most distant from the rotation axis O. Since the front surface 1A of the ink cartridge 1 rotates about the rotation center axis O so as to describe a large circle, the joint section 145 positioned in the proximity of the front surface 1A moves so as to describe a large circle along arrow F1 and securely connected to the needle member 21 of the inkjet head 200. The rotation center axis O of this embodiment is set at a position outside the ink cartridge 1 and opposite to the front surface 1A.

When an ink supply route from the ink cartridge 1 to the sub tank of the inkjet head 200 is formed by connecting the needle member 21 and the joint section 145 in this manner, ink stored in the ink cartridge 1 can be supplied to the sub tank through the ink supply route. Ink may be supplied in any method, for example, supplied by sucking a predetermined amount of ink from the ink cartridge 1 with the aid of negative pressure of a pump connected to the inkjet head 200.

When printing operation is performed after ink is supplied in this manner, ink cartridge 1 is rotated in the direction indicated by arrow F2, which is the opposite direction of arrow F1, by the driving mechanism (not shown) installed in the inkjet printing apparatus. By the rotation, the connection between the needle member 21 of the inkjet head 200 and the joint section 145 of the ink cartridge 1 is released, and thereby the inkjet head 200 can be moved together with the carriage in the main scanning direction indicated by arrow E. Hence, printing operation can be performed while moving the inkjet head 200 in the main scanning direction.

After a predetermined printing operation is completed, the inkjet head 200 is moved again to the home position and then ink cartridge 1 is rotated in the direction indicated by arrow F1. As a result, the needle member 21 of the inkjet head 200 is connected to the joint section 145 of the ink cartridge 1 to replenish the sub tank with ink. In this way, the sub tank of the inkjet head 200 is intermittently and repeatedly replenished with ink.

Every time replenishment of the sub tank with ink is repeated in this way, the operation for connecting the needle member 21 to the joint section 145 by insertion and the operation for disconnecting them are repeated. In these operations, the ink cartridge 1 is rotated in the directions of arrows F1 and F2 (up and down direction in this embodiment) by the driving mechanism (not shown) installed in the inkjet printing apparatus, as described above. Any driving mechanism may be used as long as it has, for example, a driving shaft which moves up and down in the inkjet printing apparatus. In this case, when installation of the ink cartridge 1 in a predetermined installation section of the inkjet printing apparatus is completed, a groove-form portion 170 for receiving rotatory motion provided in the ink cartridge 1 is engaged with the driving shaft of the driving mechanism. With this mechanism, the ink cartridge 1 can be rotated in the directions indicated by arrows F1 and F2 in accordance with the up and down motion of the driving shaft. The driving mechanism may have any structure as long as the ink cartridge 1 can be moved in the direction along which the joint section 145 can be connected and disconnected to the needle member 21.

Figure 5A:
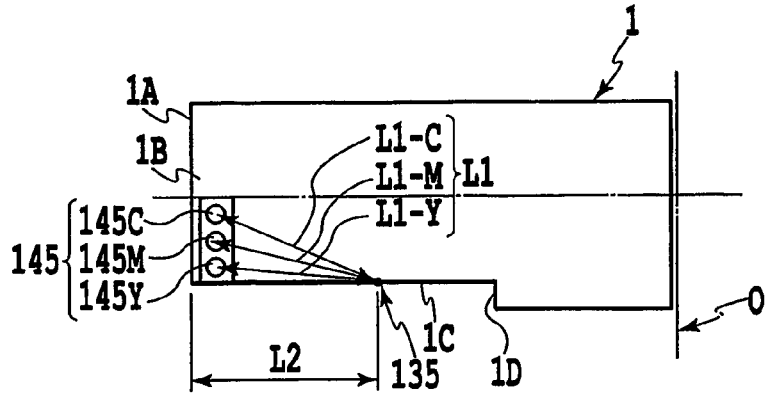
FIG. 5A is a schematic plan view of the ink cartridge according to Embodiment 1 of the present invention.
Figure 5B:
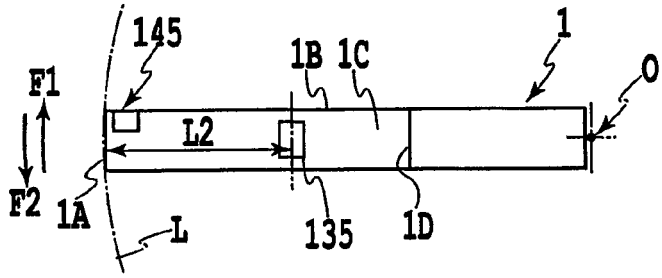
FIG. 5B is a schematic side view of the ink cartridge of FIG. 5A.

FIGS. 5A to 5D are schematic views showing the gist portion of the ink cartridge 1. FIG. 5A is a schematic top view of the ink cartridge 1 shown in FIG. 1. FIG. 5B is a side view of the ink cartridge 1 shown in FIG. 5A viewed from the side of the engage reference portion 135.

In FIG. 5A, reference characters L1-Y, L1-M and L1-C are the distances from the engage reference portion 135 to the joint sections 145Y, 145M and 145C, respectively. They are also collectively referred to as "distance L1" from the engage reference portion 135 to the joint section 145. Similarly, reference character L2 of FIG. 5B is the distance from the engage reference portion 135 to the front surface 1A. In other words, the distance L2 is defined as the shortest distance between the front surface 1A and the engage reference portion 135, more precisely, the distance between the engage reference portion 135 and the point of the front surface 1A that is most closest to the engage reference portion 135. The front surface 1A is the surface which comes into contact with the trail L described by the outermost peripheral portion of the ink cartridge 1 when the ink cartridge 1 is rotated about the rotation central axis O in the directions of arrows F1 and F2, as described above.

In this embodiment, the distance L1 from the joint section 145 of the ink cartridge 1 to the engage reference portion 135 is shorter than the distance L2. That is, each of the distances L1-Y, L1-M and L1-C is shorter than the distance L2.

Figure 5C:
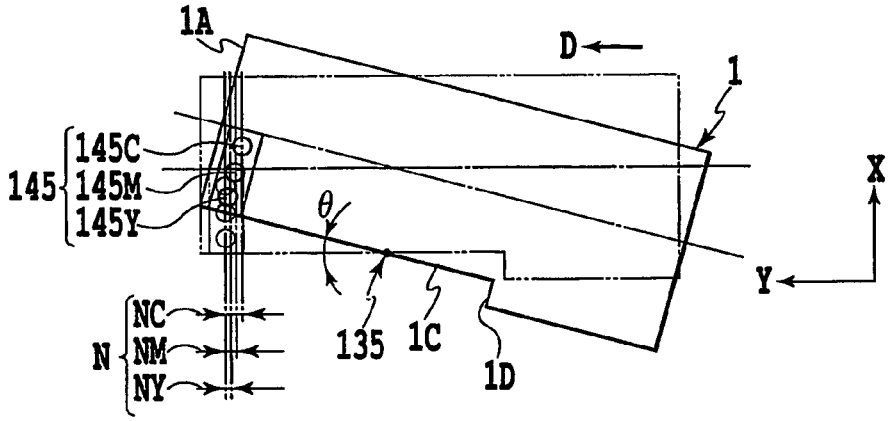
FIG. 5C is a schematic plan view of the ink cartridge of FIG. 5A in wobbling.
Figure 5D:
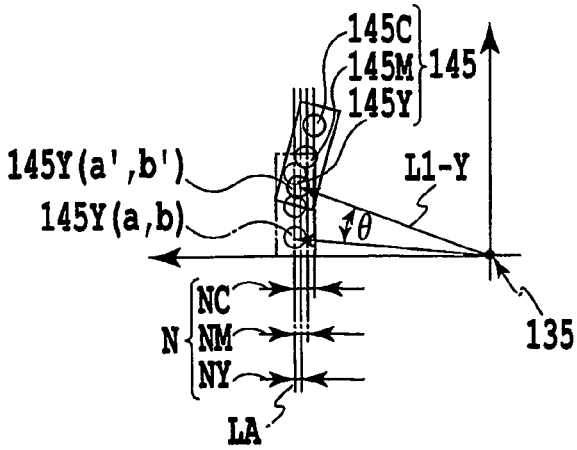
FIG. 5D is a graph for explaining the deviation of the joint section when the ink cartridge of FIG. 5A wobbles.

To install the ink cartridge 1 successfully into a predetermined cartridge housing section (installation section) within the inkjet printing apparatus, usually the cartridge housing section is designed to have a clearance between them. Therefore, the ink cartridge 1 is installed with slight wobbling. More specifically, as shown in FIG. 5C, the ink cartridge 1 slightly wobbles around the engage reference portion 135 used as a reference position when the ink cartridge 1 is installed. In FIG. 5C, degree of wobbling of the ink cartridge 1 is exaggerated for convenience' sake.

As described above, the ink cartridge 1 is fixed in the inkjet printing apparatus by engaging the engage reference portion 135 with the fixation pin (not shown) provided at a predetermined position of the inkjet printing apparatus. Therefore, the ink cartridge 1 is installed in the inkjet printing apparatus with the engage reference portion 135 used as a reference position, and wobbles around the engage reference portion 135, as shown in FIG. 5C. Thus, the position of the ink cartridge 1 installed deviates toward rotation direction around the engage reference portion 135 by the degree of wobbling.

Such a positional deviation of the ink cartridge 1 can be reduced by lowering the degree of wobbling of the ink cartridge 1 by reducing the clearance between the cartridge housing section of the inkjet printing apparatus and the ink cartridge 1. However, the clearance is too narrow, it becomes difficult to install in the ink cartridge 1. Therefore, the clearance has the lowest limit.

In FIG. 5C, when the ink cartridge 1 rotates clockwise about the engage reference portion 135 by an angle of θ, the joint section 145 (145Y, 145M, 145C) deviates in the Y-axis direction by a deviation amount N (NY, NM, NC). In short, when the joint section 145Y rotates and describes the arc with a radius of distance L1-Y, the deviation amount in the Y-axis comes to NY. Similarly, when the joint section 145M rotates and describes the arc with a radius of distance L1-M, the deviation amount in the Y-axis comes to NM. When the joint section 145C rotates and describes the arc with a radius of distance L1-C, the deviation amount in the Y-axis comes to NC. In this Embodiment, the Y axis direction is in parallel to the insertion direction of the ink cartridge 1 (in the direction indicated by arrow D) and perpendicular to the X-axis direction along which the joint sections 145Y, 145M and 145C are linearly arranged. The joint sections 145Y, 145M and 145C are basically arranged linearly on the line LA of the X-axis. Therefore, the deviation amount from the line LA agrees with N (NY, NM, NC).

For example, provided that regular coordinates of the joint section 145Y on the line LA is expressed by 145Y(a, b), the coordinates of the joint section 145Y deviated from the line LA by rotation of the ink cartridge 1, can be expressed by 145Y (a', b'). The amount of deviation in the X-axis between the coordinates 145Y (a, b) and 145 Y (a', b') is expressed by NY.

As described above, the distance L1 (L1-Y, L1-M, L1-C) is set to be shorter than the distance L2. Because of this, the deviation amount N (NY, NM, NC) of the joint section 145 (145Y, 145M, 145C) becomes relatively smaller compared to the degree of wobbling of the ink cartridge 1 around the engage reference portion 135. Therefore, it is possible to suppress effect of wobbling of the ink cartridge 1 upon the deviation amount N of the joint section 145. As a result, the joint section 145 and the needle member 21 of the inkjet head 200 can be accurately aligned and securely connected.

The degree of reducing the distance L1 (L1-Y, L1-M, L1-C) than the distance L2, in other words, the degree of bringing the joint section 145 (145Y, 145M, 145C) close to the engage reference portion 135, can be appropriately regulated. Such a degree can be determined in consideration of the positional accuracy required in connecting the joint section 145 to the needle member 21.

Figure 6A:
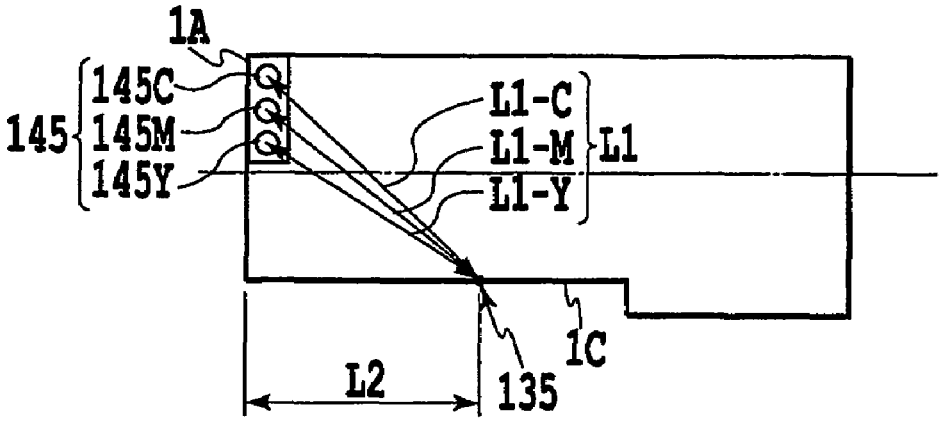
FIG. 6A is a schematic plan view of an ink cartridge according to a Comparative Example of the present invention.

FIG. 6A is a view for explaining an ink cartridge according to Comparative Example of the present invention. In the ink cartridge, the distance L1 (L1-Y, L1-M, L1-C) from the joint section 145 (145Y, 145M, 145C) to the engage reference portion 135 is longer than the distance L2. In short, each of the distances L1-Y, L1-M, and L1-C is longer than the distance L2.

Figure 6B:
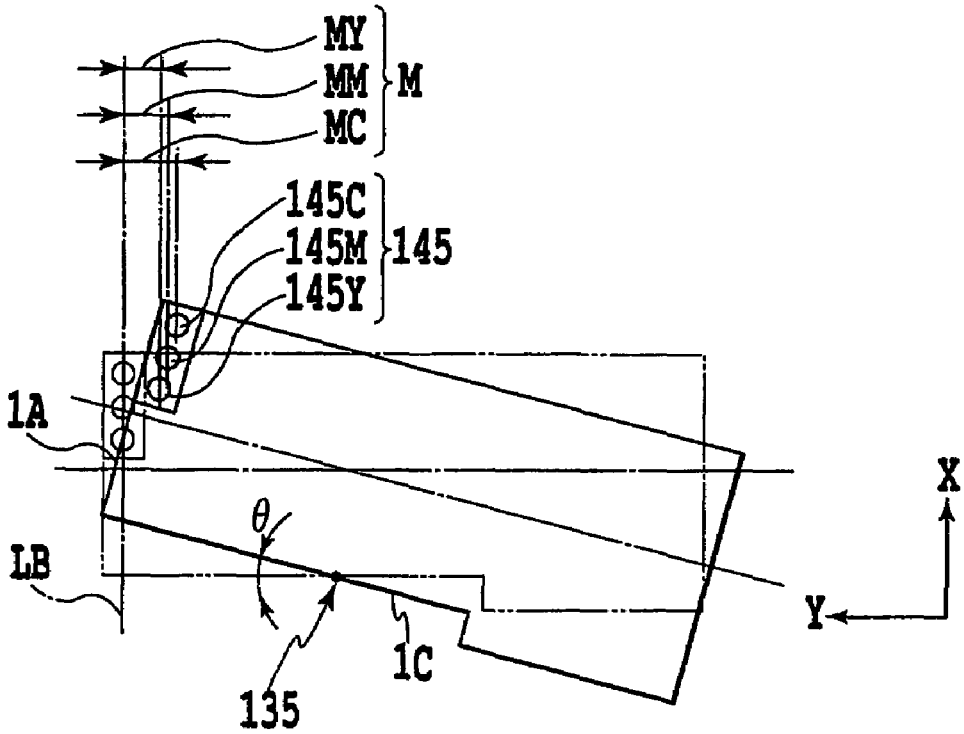
FIG. 6B is a schematic plan view of the ink cartridge of FIG. 6A in wobbling.

As shown in FIG. 6B, when such an ink cartridge rotates clockwise about the engage reference portion 135 by an angle of θ, the joint section 145 (145Y, 145M, 145C) deviates in the Y-axis direction by a deviation amount M (MY, MM, MC). The joint sections 145Y, 145M, 145C are basically arranged linearly on the line LB in the X-axis direction. The deviation amount from the line LB agrees with as M (MY, MM, MC).

The ink cartridge is assumed to wobble and rotate by an angle of θ similarly to the one shown in FIG. 5C, in the inkjet printing apparatus.

In this ink cartridge, since the distance L1 (L1-Y, L1-M, L1-C) is longer than the distance L2, the deviation amount M (MY, MM, MC) of the joint section 145 (145Y, 145M, 145C) is larger than the deviation amount N (NY, NM, NC) in Embodiment 1 of the present invention. This means that the effect of wobbling of the ink cartridge upon the deviation amount M of the joint section 145 becomes large. Therefore, it becomes difficult to accurately align and connect the joint section 145 and the needle member 21 of the inkjet head 200.

As described above, the invention of the present application makes it possible to accurately align and connect the joint section 145 and the needle member of the inkjet head 200 by setting the distance L1 to be smaller than the distance L2. Thus, even if they are connected and disconnected repeatedly many times, the rubber sealing member 300 would not be inadvertently damaged by the needle member 21. Therefore, it is possible to provide an ink cartridge having a high reliability over ink leakage. Furthermore, since the structure of the ink cartridge can be simplified, the ink cartridge can be manufactured inexpensively in a reduced size.

EMBODIMENT 2

Figure 7:
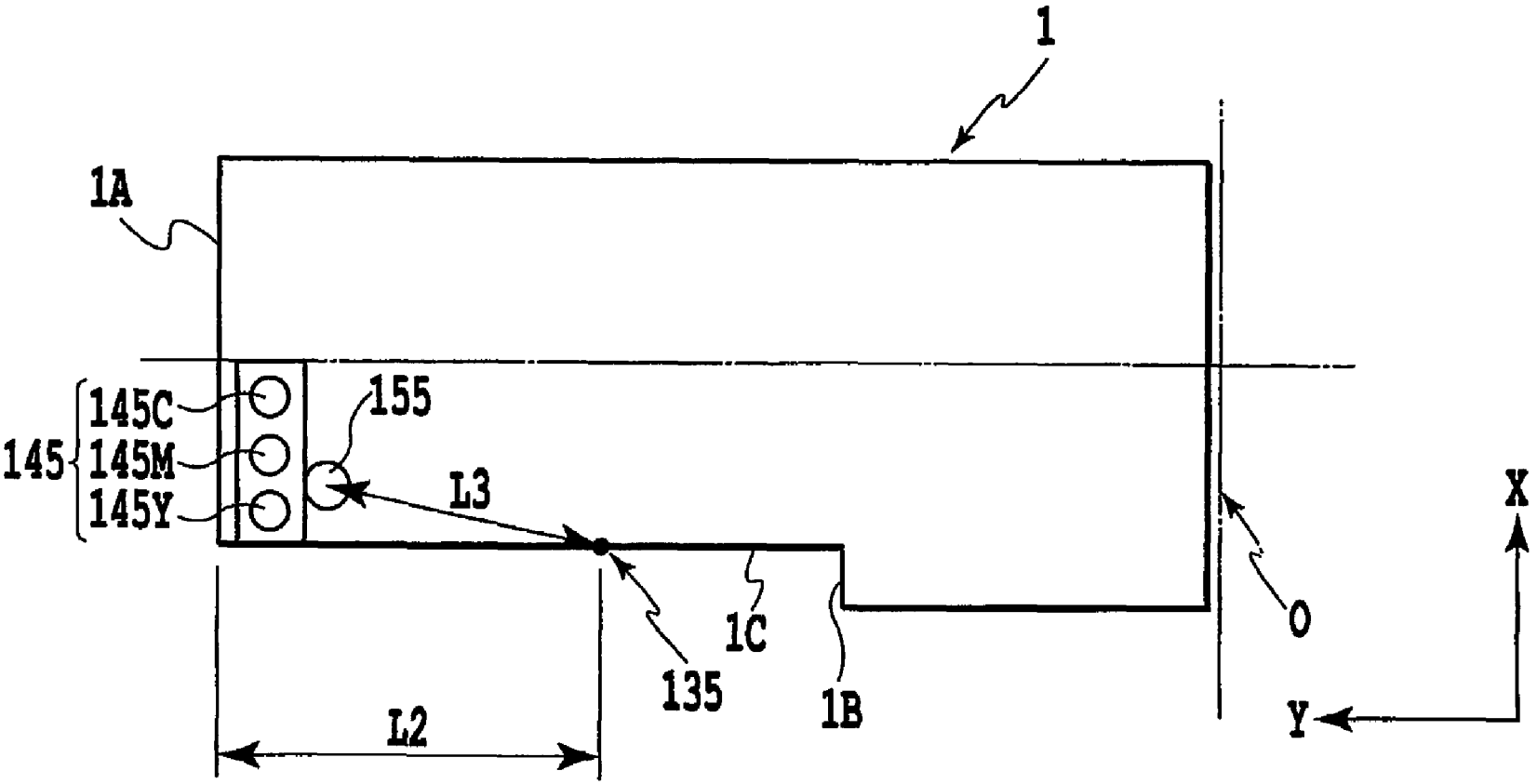
FIG. 7 is a schematic plan view of an ink cartridge according to Embodiment 2 of the present invention.
Figure 8:
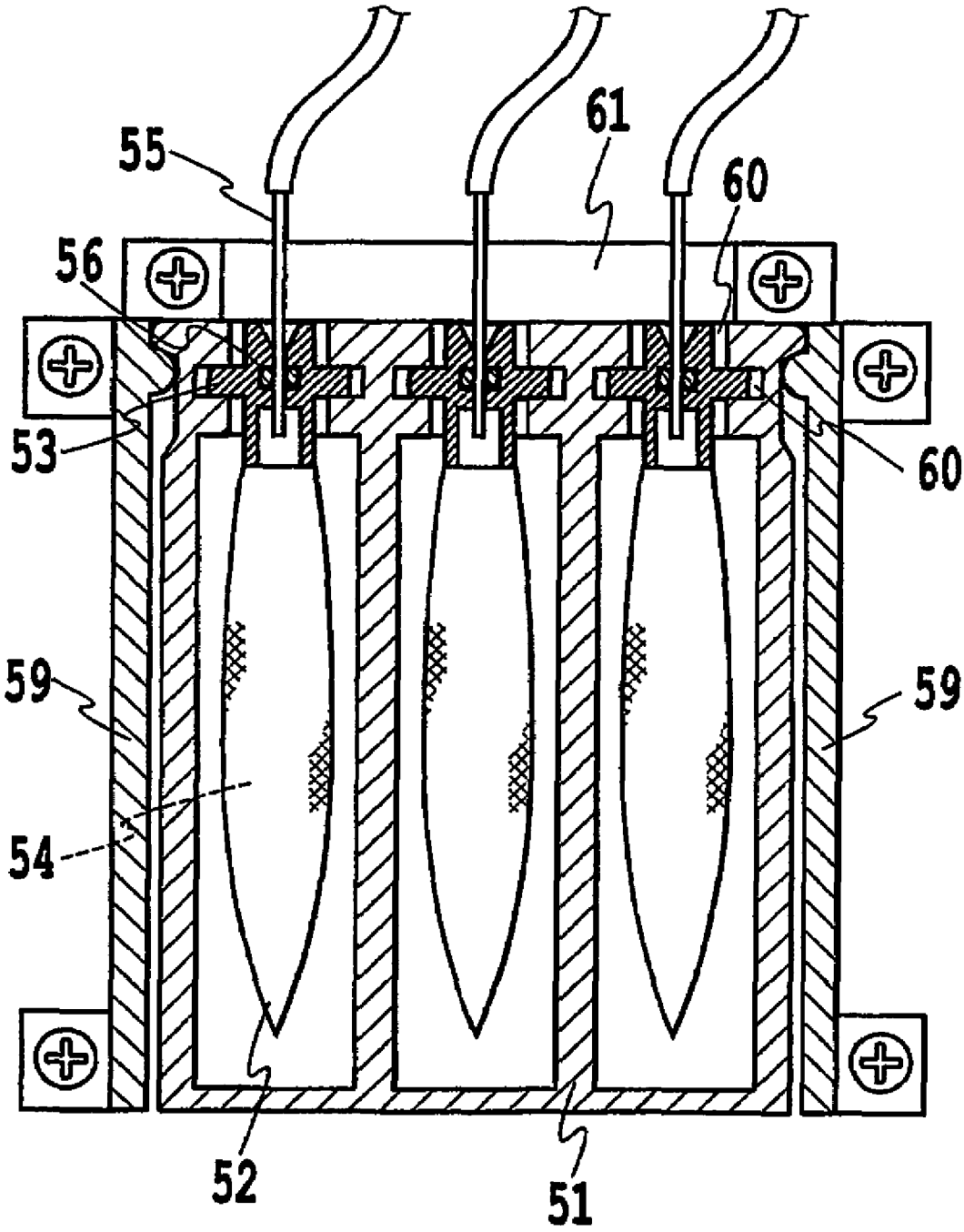
FIG. 8 is a sectional view of a conventional ink cartridge.
Figure 9:
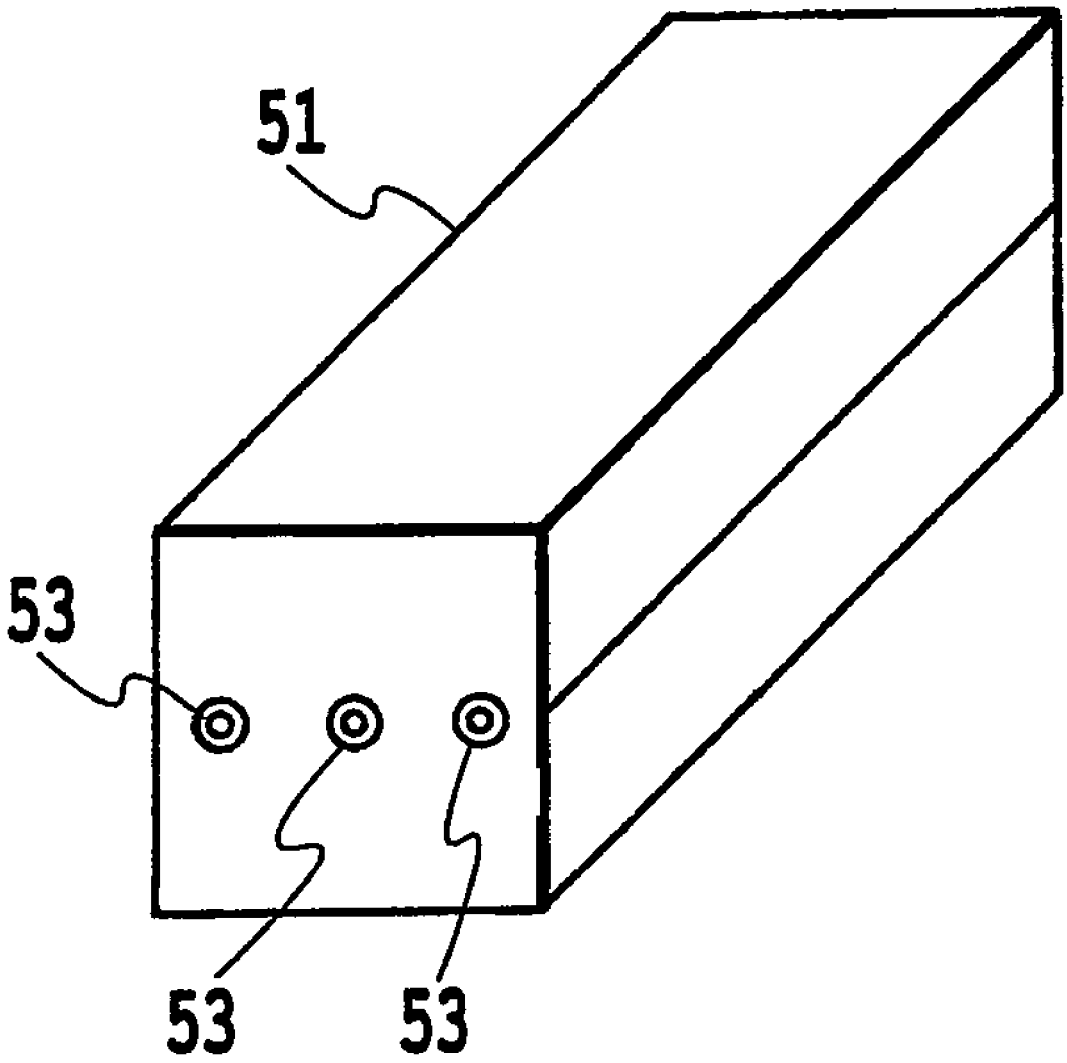
FIG. 9 is an external perspective view of the ink cartridge shown in FIG. 8.
Figure 10:
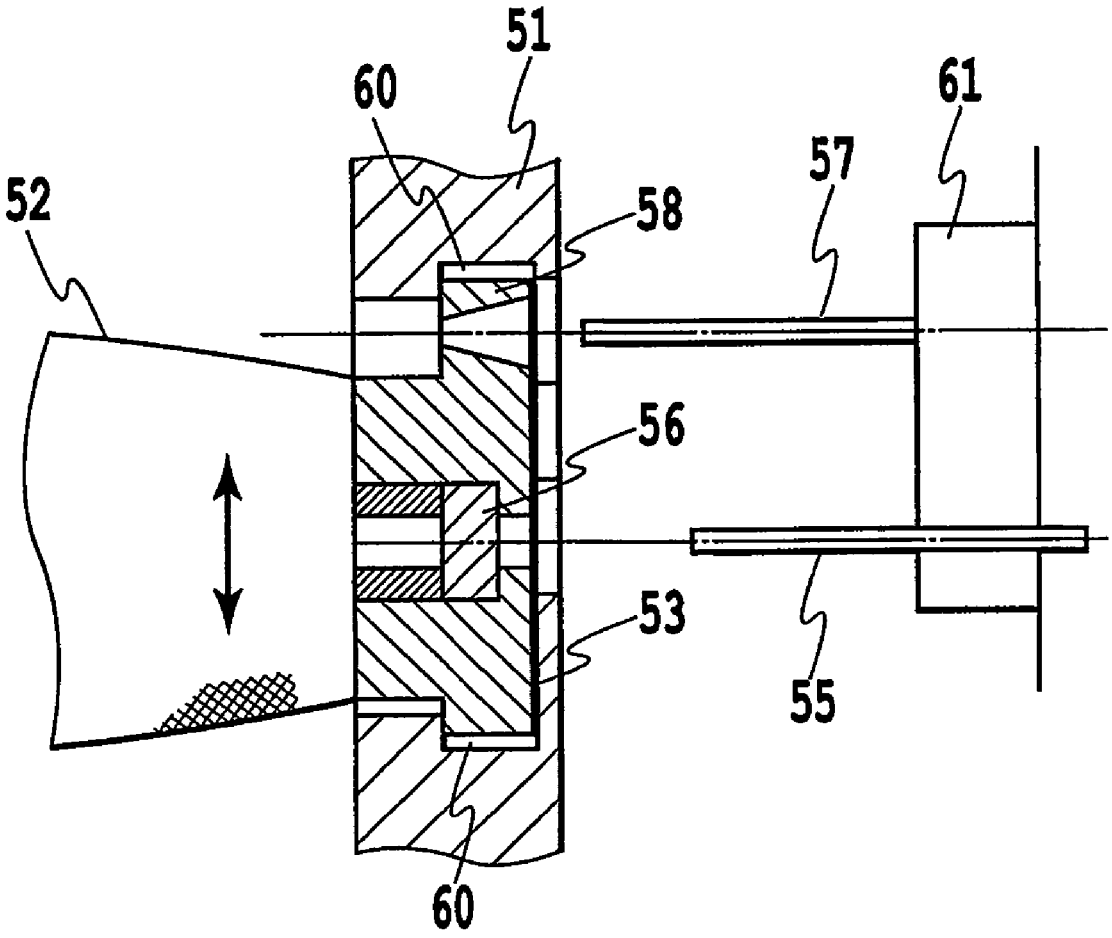
FIG. 10 is an enlarged sectional view of the connecting section of the ink cartridge shown in FIG. 8.

Embodiment 2 of the present invention will be explained with reference to FIG. 7. Note that, like reference numerals are used to designate like structural elements corresponding to those like in Embodiment 1 and any further explanation is omitted for brevity's sake.

In this Embodiment, to insert the needle member 21 of the inkjet head 200 to the joint section 145 of the ink cartridge 1 with more accuracy, a reference portion capable of engaging with the engage portion of the inkjet head 200 is provided in the inkjet cartridge 1. More specifically, as the engage portion, a tapered pin (reference axis, not shown in the figure) having a tapered tip is provided in the inkjet head 200. On the other hand, a reference hole 155 into which the tapered pin can be inserted, is provided as the reference portion in the ink cartridge 1.

When the ink cartridge 1 is rotated about the rotation center axis O to connect the ink cartridge 1 to the inkjet head 200, first, the tapered pin is guided into the reference hole 155. By this mechanism, the ink cartridge 1 and inkjet head 200 are aligned such that the joint section 145 faces the needle member 200, and thereafter, the needle member 21 is inserted into the joint section 145. Therefore, the needle member 21 can be more accurately inserted into the right position of the joint section 145.

The distance from the reference hole 155 to the engage reference portion 135 is defined as L3. The distance L3 is shorter than the distance L2. Because of this, even if the ink cartridge 1 wobbles around the engage reference portion 135, the effect of wobbling upon deviation of the reference hole 155 in the Y-axis direction can be suppressed to a minimum. As is the case with the relationship between the distance L1 and the distance L2, the effect of wobbling of the ink cartridge 1 upon deviation of the joint section 145 in the Y-axis direction can be suppressed to a minimum by setting the distance L1 to be shorter than the distance L2. Provided that the distance L3 is made longer than the distance L2, the effect of wobbling of the ink cartridge 1 upon the deviation of the reference hole 155 in the Y-axis direction becomes large.

As mentioned above, by setting the position of the reference hole 155 such that the distance L3 is shorter than the distance L2, the tapered pin can be accurately guided into the reference hole 155, and thereby the needle member 21 and the joint section 145 can be aligned more accurately and connected more securely. Note that the distance L3 of this Embodiment is set to be shorter than the distance L1 mentioned above.

The structures of Embodiments 1 and 2 of the present invention are particularly suitable for an ink cartridge used in a pit-in system. In short, since the alignment accuracy of the joint section between an ink cartridge and an inkjet head can be increased in a pin-in system, a reliable ink cartridge can be constructed in a reduced size.

In Embodiments 1 and 2, since the needle member 21 is inserted into the center portion of the joint section 145 (center portion of the sealing member 300), the distance between the center portion of the joint section 145 and the engage reference portion 135 is defined as L1. Any distance may be defined as the distance L1 as long as it is the distance between a portion within the joint section 145 connectable to the ink supply route of the inkjet head 200 and the engage reference portion 135. The ink supply route of the inkjet head 200 may be constructed discretely from the inkjet head 200.

In Embodiments 1 and 2, since the tapered pin is guided while being inserted in the center portion of the reference hole 155, the distance between the center portion of the reference hole 155 and the engage reference portion 135 is defined as the distance L3. Any distance may be defined as the distance L3 as long as it is the distance between a portion within the reference hole (reference portion) 155 capable of engaging with the tapered pin (engaging portion) and the engage reference portion 135.

The invention claimed is:

1. An ink supplying system, comprising:

an ink cartridge having a joint section for supplying ink contained in the ink cartridge to an exterior and having an engage reference portion for serving as a reference position in installing the ink cartridge;

an installation section in which the ink cartridge is installed;

an engage portion provided on the installation section, the engage portion being structured to engage with the engage reference portion; and an ink drawing member having a predetermined positional relationship with the installation section, the ink drawing member being constructed for connection with the joint section to draw the ink from the ink cartridge, wherein when the ink cartridge is installed in the installation section, the engage reference portion engages with the engage portion to position the ink cartridge in the installation section so that the joint section is positioned for connection to and disconnection from the ink drawing member, after the ink cartridge is installed in the installation section, the joint section is connected to and disconnected from the ink drawing member by rotating the ink cartridge about a predetermined rotation center axis in the installation section, the joint section is positioned in the proximity of one end of the ink cartridge, the one end being farthest removed from the predetermined rotation center, the engage reference portion is positioned between the one end and a second end opposite to the one end of the ink cartridge, an outer face of the ink cartridge at which the engage reference portion is positioned, an outer face of the ink cartridge at which the joint section is positioned, and the one end, are all mutually differ and adjoin, and the distance L1 between the joint section and the engage reference portion is shorter than the distance L2 between the one end and the engage reference portion.

2. The ink supplying system according to claim 1, further comprising an inkjet head having an engage portion, wherein the ink cartridge includes a reference portion positioned for engagement with the engage portion of the inkjet head, and the distance L3 between the reference portion and the engage portion is shorter than the distance L2.

* * * * *